United States Patent [19]

Kless

[11] 4,110,903

[45] Sep. 5, 1978

[54] METHOD OF MAKING INDUCTION COILS

[75] Inventor: Benjamin Kless, Teaneck, N.J.

[73] Assignee: Vwnding Components, Inc., Hackensack, N.J.

[21] Appl. No.: 738,334

[22] Filed: Nov. 5, 1976

[51] Int. Cl.[2] ..... H01F 41/06

[52] U.S. Cl. ..... 29/605; 336/192; 336/205; 336/206

[58] Field of Search ..... 29/605; 264/272; 336/205, 206, 208, 209, 192

[56] References Cited

U.S. PATENT DOCUMENTS

| | | | |
|---|---|---|---|
| 2,375,309 | 5/1945 | McCoy | 336/208 |
| 2,929,132 | 3/1960 | Wohlhieter | 29/605 |
| 3,171,091 | 2/1965 | Goldsmith | 336/209 X |
| 3,831,267 | 8/1974 | Onishi et al. | 29/605 X |

*Primary Examiner*—Carl E. Hall

*Attorney, Agent, or Firm*—Roy C. Hopgood; John M. Calimafde; Charles W. Neill

[57] ABSTRACT

The induction coil of this invention is wrapped on a non-metallic core with convolutions of the coil adjacent to one another. An adhesive tape is applied over the convolutions with a lapped seam of the tape and with the tape preferably extending beyond both ends of the coil in order to hold the convolutions of coil against moving with respect to one another while the coil is being transported from the winding step to the next operation in which a jacket is molded over the coil in a cavity of an injection molding machine.

11 Claims, 7 Drawing Figures

METHOD OF MAKING INDUCTION COILS

BACKGROUND AND SUMMARY OF THE INVENTION

Loading coils for radio antennae, and particularly for citizen's band radios, must have an impedance which is balanced with other parts of the radio circuit in order to obtain satisfactory results. In the manufacture of radios, it is highly desirable to have uniformity in the loading coils, so that each radio does not have to be independently tuned in order to match its loading coil. It is an object of the present invention to provide a method of making loading coils that have uniform characteristics, especially impedance.

In addition to having the same number of turns of wire on cores of the same size, it is important to have the convolutions of the coil uniform in their positions adjacent to one another. Even when coils are wound with great uniformity, however, the uniformity can be destroyed by displacement of convolutions during transport of the coil from one operation to another or by the flow of insulating material into the mold cavity of an injection molding machine.

In accordance with the method of this invention, wire coils are wound around non-metallic cores with connectors at opposite ends of the cores and confronting sides of the connectors forming flanges at opposite ends of a bare section of the non-metallic core that extends between the connectors. The wire is carefully wrapped on the core at a location between the flanges and spaced from each flange and with an end portion of the wire attached to a corresponding connector.

Before moving the coil or wire from the location at which it has been wound, a short length of adhesive tape is applied over the wire with the tape long enough to extend around the circumference of the coil and slightly further so as to provide an overlap seam for the tape. The tape is of a width slightly greater than the axial length of the coil, so that the tape not only surrounds the full circumference of the coil but also extends for a short distance beyond both ends of the coil. Pressure is then applied to the tape while the core rotates so as to put the end portions of the tape, beyond the coil, in adhering contact with the core. This holds the wire of the coil against any movement while the assembly is transported to the next operation in the manufacture of the loading coil.

The tape-wrapped coil is placed in a cavity of molding apparatus and insulating material is introduced into the cavity to form a jacket around the coil and the portions of the core beyond the ends of the coil. The adhesive tape, which is preferably a polyester insulating tape, is left on the coil and is a permanent part of the coil after the insulation has been applied over the tape. Even when using high pressure injection molding machines, the rush of molten material into the cavity cannot displace or alter the relationship of the convolutions of the coil to one another, because they are held in place by the tape and the molten material does not ever have direct contact with any of the convolutions.

Other objects, features and advantages of the invention will appear or be pointed out as the description proceeds.

BRIEF DESCRIPTION OF DRAWING

In the drawing, forming a part hereof, in which like reference characters indicate corresponding parts in all the views.

DESCRIPTION OF PREFERRED EMBODIMENT

Figure 1:
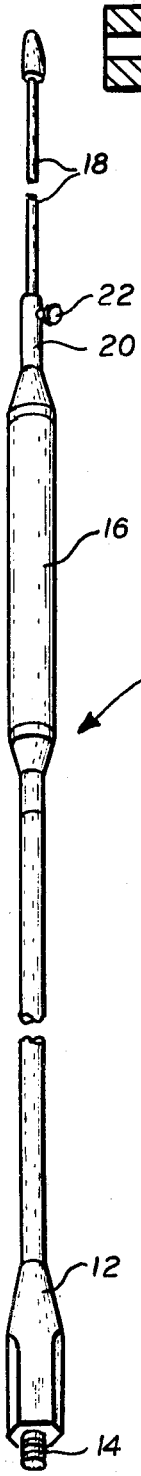
FIG. 1 is an elevation of a radio antenna, and more particularly an antenna for a citizen's band radio.

FIG. 1 shows an antenna 10 with a lower section 12 having screw threads 14 for connecting it with a support. A loading coil 16 is connected with the upper end of the lower portion 12, and there is an upper part or whip section 18 which fits into a socket 20 at the upper end of the loading coil 16. The length of the upper part 18 which is exposed can be adjusted within a limited range by moving the upper portion further up or further down in the socket 20. A set screw 22 is provided for holding the upper part 18 in its adjusted position. If the upper part 18 has to be shortened more than pushing it further into socket 20 can accomplish, a portion of the lower end of the upper part 18 is cut off.

Figure 2:
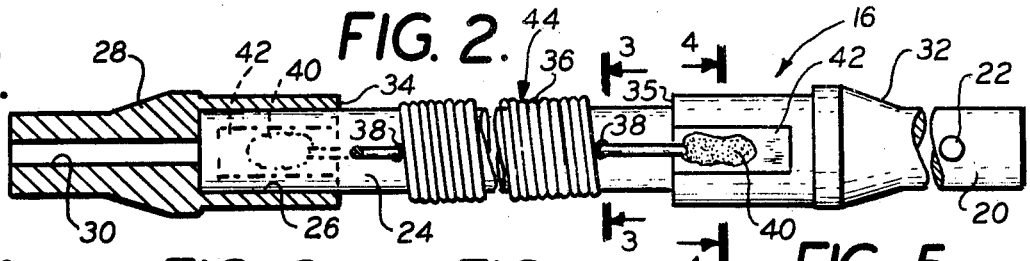
FIG. 2 is a larger scale view, partly broken away and partly in section, of the loading coil of the antenna shown in FIG. 1.
Figure 3:
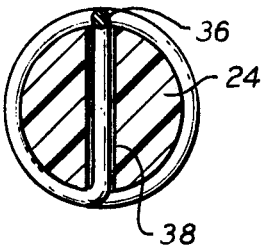
FIGS. 3 and 4 are enlarged, sectional views taken on the lines 3—3 and 4—4 of FIG. 2.
Figure 4:
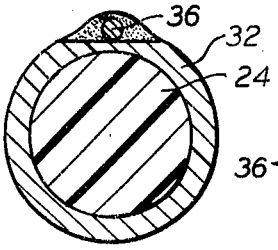

FIG. 2 shows the construction of the loading coil 16. It includes a non-metallic core 24 made of insulating material. This core 24 extends into a socket 26 in an end connector 28.

The end connector 28 is made of metal and constitutes a part of the circuit of the antenna. There is an axially extending opening 30 in the connector 28 which is coaxial with the socket 26. The opening 30 is closed at one end by the end face of the core 24.

A similar end connector 32 is fitted over the other end of the core 24, the construction being like that of the connector 24, except for the greater length of the socket portion 20.

The opposite ends of the core 24 fit tightly into the sockets in the end connectors 28 and 32. The confronting faces of the end connectors which extend beyond the cylindrical surface of the core 24 provide shoulders or flanges 34 and 35 at opposite ends of what is originally a bare, exposed cylindrical surface of the core 24.

The core 24, with the end connectors 28 and 32 firmly assembled therewith, is preferably placed between centers of a lathe or similar machine by which the core 24 and end connectors 28 and 32 are rotated as a unit about their longitudinal axis.

Before starting the rotation, a length of wire 36 is inserted through an opening 38 which extends through the core 24 on a diameter of the core. Enough wire is left beyond the opening 38 to reach beyond the flange 35 for connecting with the connector 32, as will be explained later.

Rotation of the core 34 is then begun, and wire 36 is supplied to the rotating core 24 until a predetermined number of turns of wire have been wrapped on the core with wire forming contacting convolutions.

The kind of wire used for loading coils of the type with which this invention is concerned is usually magnet wire coated with a varnish or other coating which provides an insulation without increasing the overall diameter of the wire to any great extent. Such magnetic wire is well known and universally used for winding magnets of relays and similar equipment.

When the required number of convolutions have been wound on the core 24, the wire is cut off with a substantial length extending beyond the last convolution of the coil; and the free end of the wire is then inserted through an opening 38' corresponding to the first opening 38. The wire is then bent to extend parallel to the axis of the antenna loading coil 16 and along the surface of the core 24 to the end connector 28. The end portions of the wire 36 are connected to the connectors 28 and 32 by solder 40 after the varnish or other insulation has been removed from the ends of the wire 36.

There are flat portions 42 on the otherwise cylindrical surfaces of the connectors 28 and 32 to prevent these connections from causing bulges in the final insulating jacket that surrounds all of the structure between the flanges 34 and 35 in the finished product.

Figure 5:
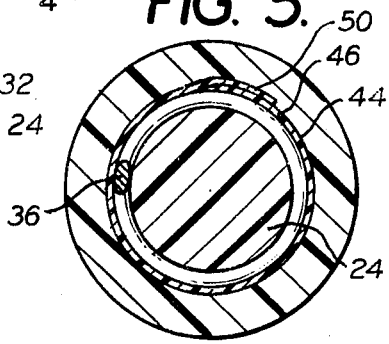
FIG. 5 is a reduced scale view of the end structure of the coil shown in FIG. 7.
Figure 6:
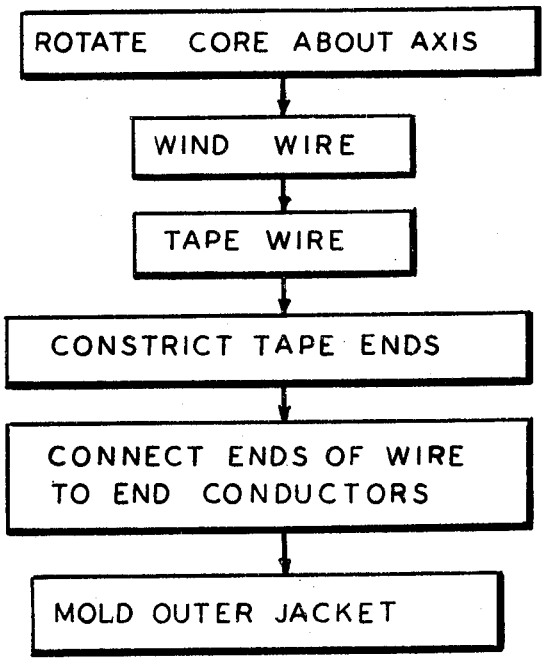
FIG. 6 is a flow diagram illustrating the various steps of making the loading coil in accordance with the method of this invention.

After the wire 36 has been wound to make the coil, designated by the reference character 44, a tape 46 (FIG. 5) is wrapped around the outside of the coil 44. This tape is preferably made of insulating material, such as polyester material. An example of such tape is manufactured by the Minnesota Mining Company and is sold under the designation "Pressure-Sensitive Tape No. 56." Another suitable tape is that made by the Tuck Manufacturing Co. and is made of Mylar (TM of DuPont Company for polyethylene terephthalate) under the designation "No. 49, CLR Rubber Adhesive."

Figure 7:
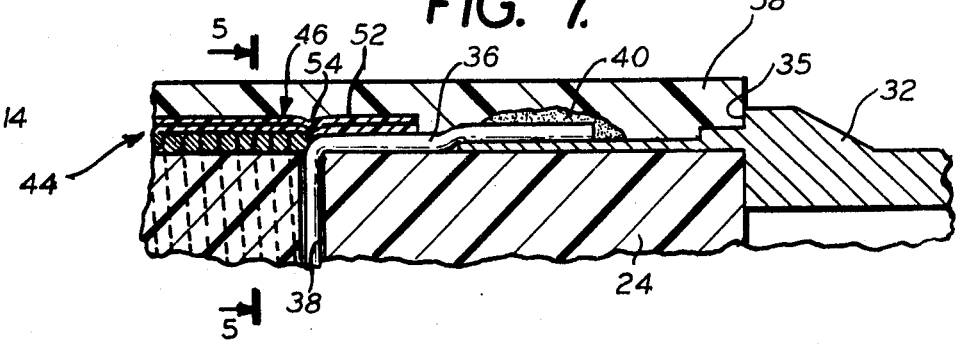
FIG. 7 is a fragmentary, greatly enlarged, sectional view taken on the line 7—7 of FIG. 2.

The tape is cut with a length in the circumferential direction slightly greater than the outside circumference of the coil 44. The axial length of the tape is slightly greater than the axial length of the coil 44. The tape 46 is applied with the core 24 and coil 44 rotating slowly, so that the adhesive side of the tape adheres to the coil 44 and the trailing edge of the tape overlaps the leading edge to form a lap seam 50. The ends of the tape 46, which extend beyond the ends of the coil 44, are pressed into contact with the core 24; these extending portions of the tape being designated in FIG. 7 by the reference character 52. FIG. 7 shows the extended end 52 passing across the top of the wire 36 which connects the coil 44 with the soldered connection 40 to the connector 32; but it will be understood that at all other locations around the circumference of the core 24, the extending end 52 of the tape is in contact with the circumference of the core 24.

According to the preferred method of this invention, a tool is held against the circumference of the tape 46 at the end of the coil 44; and this tool is pressed against the tape as the core 24 rotates, so as to form a depression 54 adjacent to the last convolution at each end of coil 44 to make an even tighter adhesion between the tape and the core 24 at the ends of the coil 44.

The core 26 with its connectors 28 and 32 and with the tape-wrapped wire coil 44 are then transferred to a mold, where an insulating jacket 58 is applied over the tape-wrapped coil 44 and over the portions of the connectors 28 and 32 which lie between the confronting flanges 34 and 35. FIG. 7 shows this jacket 58 at one end of the loading coil, and it will be understood that the construction at the other end is similar.

The insulating jacket 58 is preferably applied by putting the structure in a mold where all parts between the flanges 34 and 35 are within a cavity of the molding apparatus. The material for forming the insulating jacket 58 is then injected into the mold cavity and completely coats all of the structure between the flanges 34 and 35 with a layer of insulation which preferably extends slightly beyond the circumferential limits of the connectors 28 and 32, as shown in FIG. 7 for the connector 32.

For rapid and economical manufacture, the molding apparatus is preferably a high-pressure injection mold. The molten insulating material 58, injected into the mold cavity at high velocity, is practical with the method of this invention because the tape 46 completely surrounds and encloses the coil 44 so that no impact of molten material can dislodge end convolutions of the coil 44 since the tape 46 prevents the molten material from ever coming in contact with the convolutions of the coil. As soon as the molten insulating material 58 has cooled enough to hold its shape, the successive loading coils are discharged from the injection molding machine, in accordance with conventional practice with such molding machines.

Various kinds of material can be used for the insulation 58. It should be a material that affords good mechanical protection to the structure over which it is molded and a material that will adhere tenaciously to the metal of the connector 32 of FIG. 7 and the corresponding connector at the other end of the loading coil. This prevents moisture or water from seeping into the interior of the construction along the interface between the insulation jacket 58 and the confronting surface of the connector 32. The insulation 58 also adheres to the solder 40, the tape 46 and to the core 24 where the core is exposed beyond the end of the connector 32.

The insulating jacket 58 is preferably a glass-filled polyester. Such material can be obtained under the trade designation "Thermoset Polyester 1412-A" from Glastic Corp at 4321 Glenridge Road, Cleveland, Ohio 44121. Another source for suitable material for the insulation 58 is the Cincinnati Development and Manufacture Co., 5614 Wooster Pike, Cincinnati, Ohio 45221. This source sells the material under the designation "P-5003-FR Insulstruc."

The preferred embodiment of the invention has been illustrated and described, but changes and modifications can be made, and some features can be used in different combinations without departing from the invention as defined in the claims.

What is claimed is:

1. The method of making a loading coil for a citizen's band radio antenna, which comprises connecting metal terminals to opposite ends of a non-metallic core of smaller diameter than the metal terminals with confronting faces of the terminals forming flanges at opposite ends of the core that extend between them, winding a wire in a coil around a part of the length of the core with the ends of the coil spaced from both flanges, applying an adhesive tape around the outside of the coil to hold the convolutions of the coil firmly in their positions as wrapped on the core, inserting the core and the tape-wrapped coil in the cavity of a molding apparatus, injecting insulating material into the mold around the tape-wrapped coil and molding a jacket over the tape-wrapped coil throughout the full length of the distance between the flanges.

2. The method described in claim 1 characterized by wrapping the coil of wire with a tape that has a width wider than the axial length of the coil and with opposite edges of the tape extending beyond the end of the coil, and using a length of said tape that is somewhat greater than the outside circumference of the coil of wire with one circumferential end of the tape extending beyond the other circumferential end to form a lap seam with adhesive on the inside surface of the tape adhering to the outside of the coil convolutions and overlapped area of the tape at the lap.

3. The method described in claim 2 characterized by pressing the portions of the adhesive tape, that extend beyond the ends of the coil, into adhering contact with the core beyond the ends of the coils.

4. The method described in claim 2 characterized by injecting hot molding material into the mold over the entire surface of the core between the flanges, and removing the assembly from the mold when the insulating material becomes cool enough to retain its shape.

5. The method described in claim 4 characterized by injecting the insulation into the mold cavity at a temperature which will adhere the insulating material to the tape, exposed core area and to the flanges.

6. The method described in claim 1 characterized by connecting to the opposite ends of the non-metallic core metal connectors that have hollow end sections with openings therethrough for receiving other parts of an antenna system with which the loading coil is intended to be used.

7. The method described in claim 6 characterized by extending the core for a substantial distance into each of the end connectors, and adhering the insulation to the faces of the end connectors to seal the construction against entrance of moisture through the openings in the end connectors and along interfaces of the insulation and the coil and tape.

8. The method described in claim 1 characterized by wrapping the wire in a coil on an intermediate portion of the length of the non-metallic core and with ends of the coil of wire extending from each end of the coil to the connector at the corresponding end of the non-metallic core.

9. The method of winding and insulating a coil of wire on a non-metallic core which has metal ends, said method including wrapping the wire in adjacent convolutions around the non-metallic core and for a predetermined number of convolutions, the coil being of shorter axial length than the distance between the metal ends, protecting the wire and maintaining the convolutions in their wrapped relationship with respect to one another by wrapping a tape over the entire length of the coil before moving the core and coil to a location for another operation, thereafter applying insulation around the tape-covered coil by inserting the core and the tape-wrapped coil in the cavity of a molding apparatus, injecting insulating material into the mold around the tape-wrapped coil and molding a jacket over the tape-wrapped coil throughout the full length of the coil and beyond the opposite ends thereof.

10. The method described in claim 9 characterized by wrapping coated magnet wire around the non-metallic core to form the coil.

11. The method described in claim 9 characterized by inserting an end of the wire through an opening in the non-metallic core before starting the wrapping of the wire and with the end of the wire beyond the opening long enough to reach to a connector with which the coil is intended to be used, wrapping the coil around the non-metallic core by relative rotation of the core and a source of the wire, and then inserting an end of the wire through the core and with an excess length sufficient to reach to another connector at the end of the coil remote from the wire for connection with the first connector.

* * * * *